US011852039B1

(12) United States Patent
Neil et al.

(10) Patent No.: US 11,852,039 B1
(45) Date of Patent: Dec. 26, 2023

(54) STEAM TURBINE WITH REDUNDANT LOW PRESSURE SECTION

(71) Applicant: Elliott Company, Jeannette, PA (US)

(72) Inventors: Adam Reed Neil, Irwin, PA (US); Stephen Todd Omatick, Mount Pleasant, PA (US); Klaus Brun, Export, PA (US)

(73) Assignee: Elliott Company, Jeannette, PA (US)

( * ) Notice: Subject to any disclaimer, the term of this patent is extended or adjusted under 35 U.S.C. 154(b) by 0 days.

(21) Appl. No.: 18/184,810

(22) Filed: Mar. 16, 2023

(51) Int. Cl.

| | |
|---|---|
| ***F01K 13/02*** | (2006.01) |
| ***F01K 7/16*** | (2006.01) |
| ***F01K 3/18*** | (2006.01) |
| ***F01D 17/00*** | (2006.01) |
| ***F01D 19/00*** | (2006.01) |

(52) U.S. Cl.
CPC ..... *F01K 13/02* (2013.01); *F01D 17/00* (2013.01); *F01D 19/00* (2013.01); *F01K 3/185* (2013.01); *F01K 7/16* (2013.01); *F05D 2220/31* (2013.01); *F05D 2220/76* (2013.01)

(58) Field of Classification Search
CPC . F01K 13/02; F01K 3/185; F01K 7/16; F01D 17/00; F01D 19/00; F05D 2220/31; F05D 2220/76
USPC ..... 60/646, 657, 653, 677–680
See application file for complete search history.

(56) References Cited

U.S. PATENT DOCUMENTS

| | | | | |
|---|---|---|---|---|
| 3,999,787 | A * | 12/1976 | Park | F01K 7/165 290/40 R |
| 4,007,595 | A | 2/1977 | Braytenbah et al. | |
| 4,007,596 | A | 2/1977 | Braytenbah et al. | |
| 4,053,747 | A | 10/1977 | Davis | |
| 4,227,093 | A * | 10/1980 | Uram | F01D 19/00 290/40 R |
| 4,355,514 | A * | 10/1982 | Reifenberg | F01K 7/24 60/660 |
| 6,192,687 | B1 | 2/2001 | Pinkerton et al. | |
| 6,272,841 | B2 | 8/2001 | Yamamoto et al. | |
| 8,425,180 | B2 | 4/2013 | Sears et al. | |
| 11,236,640 | B2 | 2/2022 | Tamura | |
| 2012/0255303 | A1 * | 10/2012 | Labbe | F01K 7/40 60/660 |
| 2013/0044851 | A1 | 2/2013 | Winters et al. | |

* cited by examiner

*Primary Examiner* — Hoang M Nguyen
(74) *Attorney, Agent, or Firm* — THE WEBB LAW FIRM

(57) ABSTRACT

A steam turbine includes a high pressure stage, a low pressure stage, and a controller operatively connected to at least the low pressure stage. The low pressure stage includes a first low pressure section having a sensor configured for detecting operation data of the first low pressure section, and at least one second low pressure section. The controller is programmed or configured to receive the operation data from the first sensor during operation of the first low pressure section and determine at least one performance characteristic of the first low pressure section based on the operation data. The controller is further programmed or configured to turn off the first low pressure section when the at least one performance characteristic of the first low pressure section is outside a predetermined performance threshold, and turn on the second low pressure section. A method of operating the steam turbine is also disclosed.

20 Claims, 2 Drawing Sheets

STEAM TURBINE WITH REDUNDANT LOW PRESSURE SECTION

BACKGROUND OF THE DISCLOSURE

Field of the Disclosure

The present disclosure relates to a steam turbine, and in particular, to a steam turbine having a redundant low pressure section. The present disclosure further relates to a method of operating a steam turbine having a redundant low pressure section.

Description of the Related Art

Turbomachines, such as turbines, may be utilized in various industries, such as power stations, jet engine applications, marine propulsion applications, and automotive applications. Steam turbines are commonly used in large-scale industrial applications, such as ethylene plants, oil refineries, and power generation.

Steam turbines are configured to extract energy from pressurized steam and use it to conduct mechanical work via a rotor. Steam is channeled through multiple rows of stationary and rotating blades, with each row reducing the steam pressure and increasing its velocity. Steam turbines can have multiple stages arranged in series. Heated and pressurized steam enters the multi-stage turbine at a first, high pressure stage, where the steam is expanded and causes the rotor to rotate. The steam is then directed from the first, high pressure stage to one or more lower pressure stages, where the expansion process is repeated and the rotor is further rotated. The reduction of pressure at each stage causes the steam to transfer its energy to the rotor blades, thereby causing the rotor to turn. At the end of the process, the enthalpy of the steam has been reduced as the steam energy is converted into useful mechanical work, such as driving a generator to produce electricity. The steam is exhausted at the final stage and can be cooled and returned to a boiler to be reheated.

As the steam is expanded in the multi-stage turbine, steam begins to develop moisture in an intermediate stage section where the pressure and temperature conditions cross the moisture transition line. As more energy is used, steam quality is further decreased leading to a higher percentage of moisture. At this point, water droplets can form and any impurities contained in the steam will begin to drop out of the steam. These impurities can cause solid particle erosion to the rotor blades and also attach to the blades, which can lead to fouling and can cause stress corrosion blade failures. Fouling, erosion, and depositions reduce the performance and remaining life of the blade.

The impact from solid particle erosion, fouling, and water droplet erosion is one of the primary causes for outages and reduced service time in steam turbines. In harsh operating environments, such as when using geothermal steam, this can significantly reduce the operating life and efficiency of the steam turbine, thereby requiring frequent shutdowns for servicing and maintenance. Accordingly, there is a need in the art for a multi-stage steam turbine that is configured to reduce operational downtime due to scheduled servicing and maintenance.

SUMMARY OF THE DISCLOSURE

In view of the disadvantages of the prior art steam turbines, provided is an improved steam turbine that may include a high pressure stage, a low pressure stage, and a controller having at least one processor. The controller may be operatively connected to at least the low pressure stage. The low pressure stage may include a first low pressure section having a sensor configured for detecting operation data of the first low pressure section, and at least one second low pressure section. The at least one processor may be programmed or configured to: receive the operation data from the first sensor during operation of the first low pressure section; determine at least one performance characteristic of the first low pressure section based on the operation data; turn off the first low pressure section when the at least one performance characteristic of the first low pressure section is outside a predetermined performance threshold; and turn on the at least one second low pressure section.

In some embodiments or aspects of the present disclosure, the steam turbine may be configured for continuous operation during turning off of the first low pressure section and turning on of the at least one second low pressure section. The at least one performance characteristic may be an operating efficiency of the first low pressure section.

In some embodiments or aspects of the present disclosure, the steam turbine further may include a high pressure steam feed in fluid communication with the high pressure stage. The high pressure steam feed may be connected to a steam source. The steam source may be a geothermal steam source. The steam turbine further may include a low pressure steam feed in fluid communication with the first low pressure section and the at least one second low pressure section. The steam turbine further may include an intermediate pressure stage between the high pressure stage and the low pressure stage.

In some embodiments or aspects of the present disclosure, a method of operating a steam turbine having a high pressure stage and a low pressure stage may include detecting, with a sensor, operation data of a first low pressure section of the low pressure stage, and receiving, with a controller having at least one processor, the operation data from the sensor during operation of the first low pressure section. The method further may include determining, with the controller, at least one performance characteristic of the low pressure section based on the operation data. The method further may include turning off the first low pressure section when the at least one performance characteristic of the first low pressure section is outside a predetermined performance threshold, and turning on the at least one second low pressure section.

In some embodiments or aspects of the present disclosure, the steam turbine may be configured for continuous operation during turning off of the first low pressure section and turning on of the at least one second low pressure section. The at least one performance characteristic may be an operating efficiency of the first low pressure section.

In some embodiments or aspects of the present disclosure, the method of operating the steam turbine may include delivering a high pressure steam to the high pressure stage via a high pressure steam feed, wherein the high pressure steam feed is connected to a steam source. The steam source may be a geothermal steam source. The steam turbine further may include an intermediate pressure stage between the high pressure stage and the low pressure stage.

In some embodiments or aspects of the present disclosure, provided is a power generation system that may include a steam turbine and a generator driven by the steam turbine. The steam turbine may include a high pressure stage, a low pressure stage, and a controller having at least one processor. The controller may be operatively connected to at least the low pressure stage. The low pressure stage may include a first low pressure section having a sensor configured for detecting operation data of the first low pressure section, and at least one second low pressure section. The at least one processor may be programmed or configured to: receive the operation data from the first sensor during operation of the first low pressure section; determine at least one performance characteristic of the first low pressure section based on the operation data; turn off the first low pressure section when the at least one performance characteristic of the first low pressure section is outside a predetermined performance threshold; and turn on the at least one second low pressure section.

Additional embodiments or aspects of the steam turbines and methods described herein are detailed in one or more of the following clauses:

Clause 1: A steam turbine comprising: a high pressure stage; a low pressure stage; and a controller having at least one processor, the controller being operatively connected to at least the low pressure stage, wherein the low pressure stage comprises: a first low pressure section having a sensor configured for detecting operation data of the first low pressure section; and at least one second low pressure section; wherein the at least one processor is programmed or configured to: receive the operation data from the first sensor during operation of the first low pressure section; determine at least one performance characteristic of the first low pressure section based on the operation data; turn off the first low pressure section when the at least one performance characteristic of the first low pressure section is outside a predetermined performance threshold; and turn on the at least one second low pressure section.

Clause 2: The steam turbine according to clause 1, wherein the steam turbine is configured for continuous operation during turning off of the first low pressure section and turning on of the at least one second low pressure section.

Clause 3: The steam turbine according to clause 1 or 2, wherein the at least one performance characteristic is operating efficiency of the first low pressure section.

Clause 4: The steam turbine according to any of clauses 1 to 3, further comprising a high pressure steam feed in fluid communication with the high pressure stage, wherein the high pressure steam feed is connected to a steam source.

Clause 5: The steam turbine according to clause 4, wherein the steam source is a geothermal steam source.

Clause 6: The steam turbine according to any of clauses 1 to 5, further comprising a low pressure steam feed in fluid communication with the first low pressure section and the at least one second low pressure section.

Clause 7: The steam turbine according to any of clauses 1 to 6, further comprising an intermediate pressure stage between the high pressure stage and the low pressure stage.

Clause 8: Method of operating a steam turbine having a high pressure stage and a low pressure stage, the method comprising: detecting, with a sensor, operation data of a first low pressure section of the low pressure stage; receiving, with a controller having at least one processor, the operation data from the sensor during operation of the first low pressure section; determining, with the controller, at least one performance characteristic of the low pressure section based on the operation data; turning off the first low pressure section when the at least one performance characteristic of the first low pressure section is outside a predetermined performance threshold; and turning on the at least one second low pressure section.

Clause 9: The method according to clause 8, wherein the steam turbine is configured for continuous operation during turning off of the first low pressure section and turning on of the at least one second low pressure section.

Clause 10: The method according to clause 8 or 9, wherein the at least one performance characteristic is operating efficiency of the first low pressure section.

Clause 11: The method according to any of clauses 8 to 10, further comprising delivering a high pressure steam to the high pressure stage via a high pressure steam feed, wherein the high pressure steam feed is connected to a steam source.

Clause 12: The method according to clause 11, wherein the steam source is a geothermal steam source.

Clause 13: The method according to any of clauses 8 to 12, wherein the steam turbine further comprises an intermediate pressure stage between the high pressure stage and the low pressure stage.

Clause 14: A power generation system comprising: a steam turbine and a generator driven by the steam turbine, wherein the steam turbine comprises: a high pressure stage; a low pressure stage; and a controller having at least one processor, the controller being operatively connected to at least the low pressure stage, wherein the low pressure stage comprises: a first low pressure section having a sensor configured for detecting operation data of the first low pressure section; and at least one second low pressure section; wherein the at least one processor is programmed or configured to: receive the operation data from the first sensor during operation of the first low pressure section; determine at least one performance characteristic of the first low pressure section based on the operation data; turn off the first low pressure section when the at least one performance characteristic of the first low pressure section is outside a predetermined performance threshold; and turn on the at least one second low pressure section.

Clause 15: The power generation system according to clause 14, wherein the steam turbine is configured for continuous operation during turning off of the first low pressure section and turning on of the at least one second low pressure section.

Clause 16: The power generation system according to clause 14 or 15, wherein the at least one performance characteristic is operating efficiency of the first low pressure section.

Clause 17: The power generation system according to any of clauses 14 to 16, further comprising a high pressure steam feed in fluid communication with the high pressure stage, wherein the high pressure steam feed is connected to a steam source.

Clause 18: The power generation system according to clause 17, wherein the steam source is a geothermal steam source.

Clause 19: The power generation system according to any of clauses 14 to 18, further comprising a low pressure steam feed in fluid communication with the first low pressure section and the at least one second low pressure section.

Clause 20: The power generation system according to any of clauses 14 to 19, further comprising an intermediate pressure stage between the high pressure stage and the low pressure stage.

BRIEF DESCRIPTION OF THE DRAWINGS

In FIGS. 1-4, like characters refer to the same components and elements, as the case may be, unless otherwise stated.

DETAILED DESCRIPTION

Figure 1:
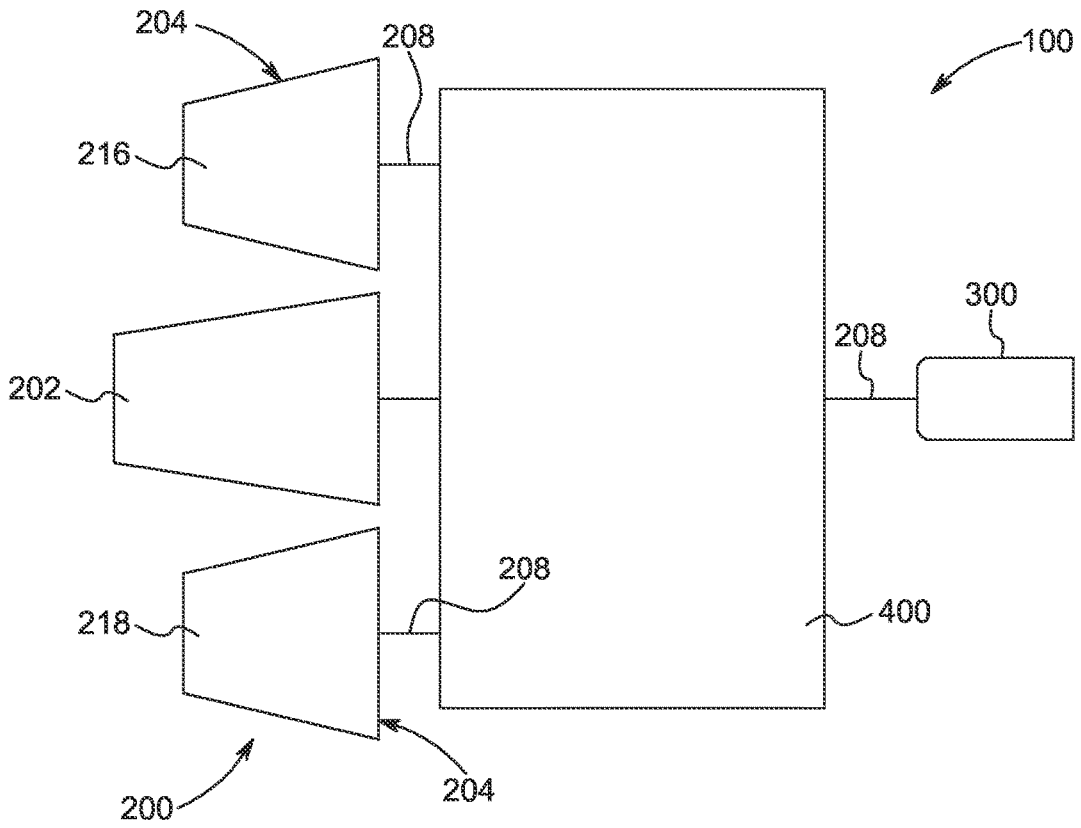
FIG. 1 is a representative schematic of a power generation system having a redundant turbine section in accordance with an embodiment or aspect of the present disclosure.

As used herein, the singular form of "a", "an", and "the" include plural referents unless the context clearly dictates otherwise.

Spatial or directional terms, such as "left", "right", "inner", "outer", "above", "below", and the like, relate to the embodiments or aspects as shown in the drawing figures and are not to be considered as limiting as the embodiments or aspects can assume various alternative orientations.

All numbers used in the specification and claims are to be understood as being modified in all instances by the term "about". By "about" is meant plus or minus twenty-five percent of the stated value, such as plus or minus ten percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

All documents referred to herein are "incorporated by reference" in their entirety.

The term "at least" is synonymous with "greater than or equal to".

The term "not greater than" is synonymous with "less than or equal to".

Some non-limiting embodiments or aspects may be described herein in connection with thresholds. As used herein, satisfying a threshold may refer to a value being greater than the threshold, more than the threshold, higher than the threshold, greater than or equal to the threshold, less than the threshold, fewer than the threshold, lower than the threshold, less than or equal to the threshold, equal to the threshold, etc.

As used herein, "at least one of" is synonymous with "one or more of". For example, the phrase "at least one of A, B, or C" means any one of A, B, or C, or any combination of any two or more of A, B, or C. For example, "at least one of A, B, or C" includes A alone; or B alone; or C alone; or A and B; or A and C; or B and C; or all of A, B, and C.

The term "includes" is synonymous with "comprises".

The term "downstream" refers to a direction that generally corresponds to the direction of the flow of working fluid through the steam turbine. The term "upstream" refers to the direction that is opposite of the direction of flow of working fluid through the steam turbine.

The term "radial" refers to movement or position perpendicular to an axis.

The term "axial" refers to movement or position parallel to an axis.

The term "circumferential" refers to movement or position around an axis.

The disclosure comprises, consists of, or consists essentially of the following examples of the embodiments or aspects, in any combination. Various examples of the disclosure may be discussed separately. However, it is to be understood that this is simply for ease of illustration and discussion. In the practice of the disclosure, one or more aspects of the invention described in one example can be combined with one or more aspects of the disclosure described in one or more of the other examples.

Figure 2:
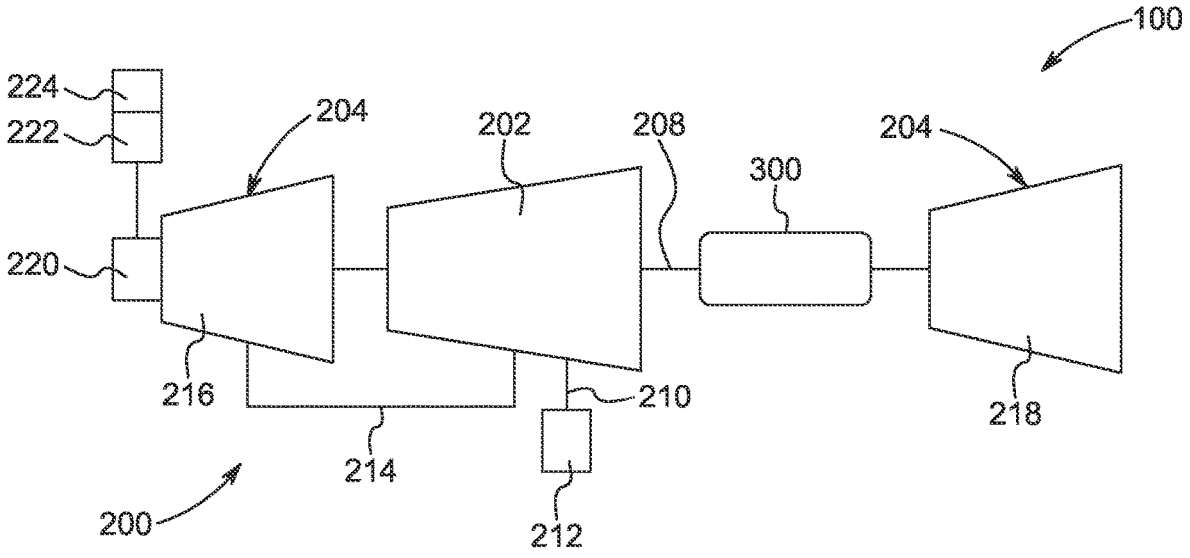
FIG. 2 is a representative schematic of a power generation system having a redundant turbine section in accordance with another embodiment or aspect of the present disclosure.

With reference to FIGS. 1-2, a schematic representation of a power generation system 100 is shown in accordance with some embodiments or aspects of the present disclosure. The power generation system 100 generally includes a steam turbine 200 and a generator 300 driven by the steam turbine 200. The power generation system 100 may be configured to generate electricity using mechanical input provided by the steam turbine 200. As shown in FIG. 1, a gearbox 400 may be connected between the steam turbine 200 and the generator 300. The steam turbine 200 may be in a parallel (FIG. 1) or a series (FIG. 2) arrangement relative to the generator 300. While FIGS. 1 and 2 show the steam turbine 200 connected to the generator for generating electricity, it should be appreciated that the steam turbine 200 can be connected to other devices for performing useful mechanical work.

Figure 3:
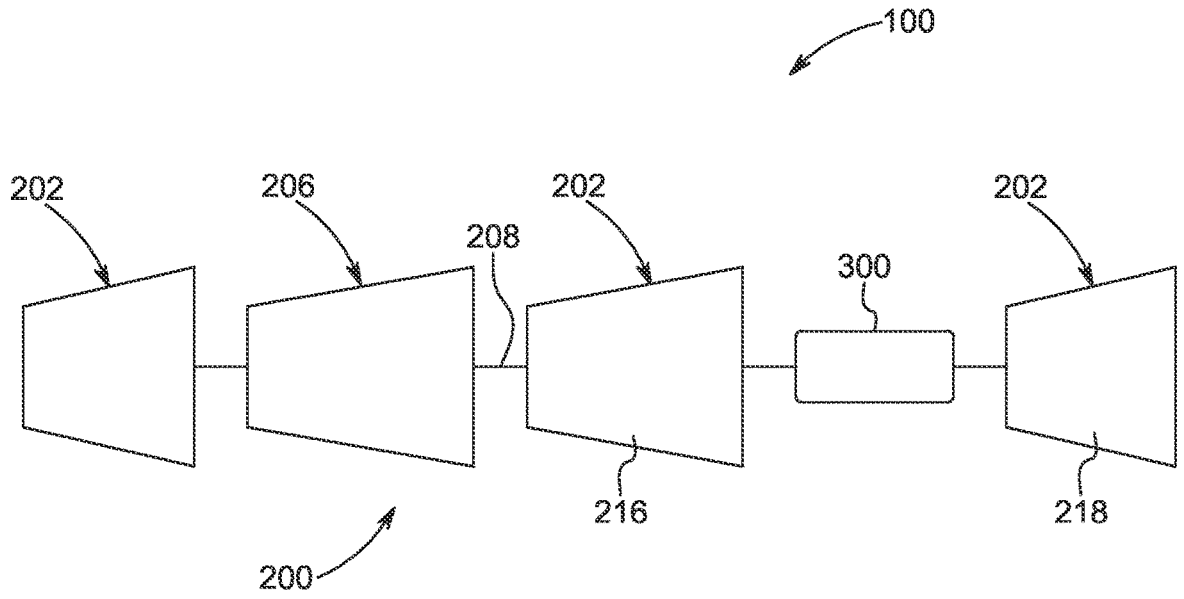
FIG. 3 is a representative schematic of a power generation system having a redundant turbine section in accordance with another embodiment or aspect of the present disclosure.

The steam turbine 200 includes a rotating assembly that includes several stages or turbine sections. For example, as shown in FIGS. 1 and 2, the steam turbine 200 may have a high pressure stage 202 and a low pressure stage 204. In further embodiments or aspects, the steam turbine 200 may have an intermediate pressure stage 206, such as shown in FIG. 3. The stages 202, 204, 206 may be connected together via a common rotor or shaft 208, such as shown in FIGS. 2-3. In some embodiments or aspects, such as shown in FIG. 1, each stage 202, 204 may have a dedicated rotor or shaft 208 connected to the gearbox 400. Generally, high pressure steam enters the high pressure stage 202 and is expanded, thereby causing rotor blades connected to the rotor or shaft 208 to rotate. The steam is then directed to the next stage, such as the intermediate pressure stage 206 or the low pressure stage 204, where the expansion process is repeated and wherein additional mechanical energy is extracted from the steam.

With reference to FIG. 2, the steam is delivered to the high pressure stage 202 via a high pressure steam feed 210 that is connected to a steam source 212. In some embodiments or aspects, the steam source 212 is a boiler. In other embodiments or aspects, the steam source 212 is a geothermal steam source connected to naturally occurring steam from within the earth. The low pressure stage 204 has a low pressure steam feed 214 for delivering expanded steam used in the high pressure stage 202. While not shown, a similar arrangement of high pressure steam feed 210 and low pressure steam feed 214 is provided on the steam turbines 200 shown in FIGS. 1 and 3.

With continued reference to FIGS. 1 and 2, the low pressure stage 204 includes a first low pressure section 216 and at least one second low pressure section 218. The at least one second low pressure section 218 is configured as a redundant low pressure section that is operable when at least one performance characteristic of the first low pressure section 216 is outside a predetermined performance threshold. For example, the at least one second low pressure section 218 may be turned off during operation of the first low pressure section 216. When the at least one performance characteristic of the first low pressure section 216 is outside the predetermined performance threshold, it may be necessary to turn off the first low pressure section 216 for service and maintenance. Normally, shutting down a turbine stage requires shutting down the entire turbine so that maintenance can be performed. However, the at least one second low pressure section 218 allows operation of the steam turbine 200 without the need to power it down while the first low pressure section 216 is serviced. In some embodiments or aspects, the steam turbine 200 is configured for continuous operation during turning off of the first low pressure section 216 and turning on of the at least one second low pressure section 218. In further embodiments or aspects, the steam turbine 200 may be configured for a temporary shutdown while the first low pressure section 216 is turned off and the at least one second low pressure section 218 is turned on.

With continued reference to FIGS. 1-2, the first low pressure stage 216 has at least one sensor 220 configured for detecting operation data of the first low pressure section 216. The at least one sensor 220 may be a temperature sensor, a velocity sensor, an accelerometer, or any other sensor configured for measuring operating data of the first low pressure section 216. In some embodiments or aspects, the at least one sensor 220 may be a plurality of sensors 220. In some embodiments or aspects, the at least one second low pressure section 218 may have the at least one sensor 220.

With continued reference to FIGS. 1-2, the steam turbine 200 has a controller 222 configured for controlling operation thereof. For example, the controller 222 may be configured for controlling operation of at least one of the high pressure stage 202 and the low pressure stage 204. In some embodiments or aspects, the controller 222 has at least one processor 224 and is operatively connected to at least the low pressure stage 204. The controller 222 may include computer readable media, such as memory, on which one or more operation protocols may be stored for execution by the at least one processor 224.

The at least one processor 224 may be programmed or configured to receive the operation data from the at least one sensor 220 during operation of the first low pressure section 216. The at least one processor 224 may be further programmed or configured to determine at least one performance characteristic of the first low pressure section 216 based on the operation data. For example, the at least one processor 224 may be configured to calculate the at least one performance characteristic based on the operation data detected by the at least on sensor 220. In some embodiments or aspects, the at least one performance characteristic may be an operating efficiency of the first low pressure section.

The at least one processor 224 may be further programmed or configured to turn off the first low pressure section 216 when the at least one performance characteristic of the first low pressure section 216 is outside a predetermined performance threshold. For example, when the at least one performance characteristic is operating efficiency, the at least one processor 224 may be programmed or configured to turn off the first low pressure section 216 when the operating efficiency is below a predetermined threshold. In other embodiments or aspects, when the at least one performance characteristic is temperature, the at least one processor 224 may be programmed or configured to turn off the first low pressure section 216 when the temperature detected by the at least one sensor 220 is above or below a predetermined threshold.

The at least one processor 224 may be further programmed or configured to turn on the at least one second low pressure section 218 during or after turning off the first low pressure section 216. As described herein, the steam turbine 200 may be configured for continuous operation during turning off of the first low pressure section 216 and turning on of the at least one second low pressure section 218. In further embodiments or aspects, the steam turbine 200 may be configured for a temporary shutdown while the first low pressure section 216 is turned off and the at least one second low pressure section 218 is turned on.

Figure 4:
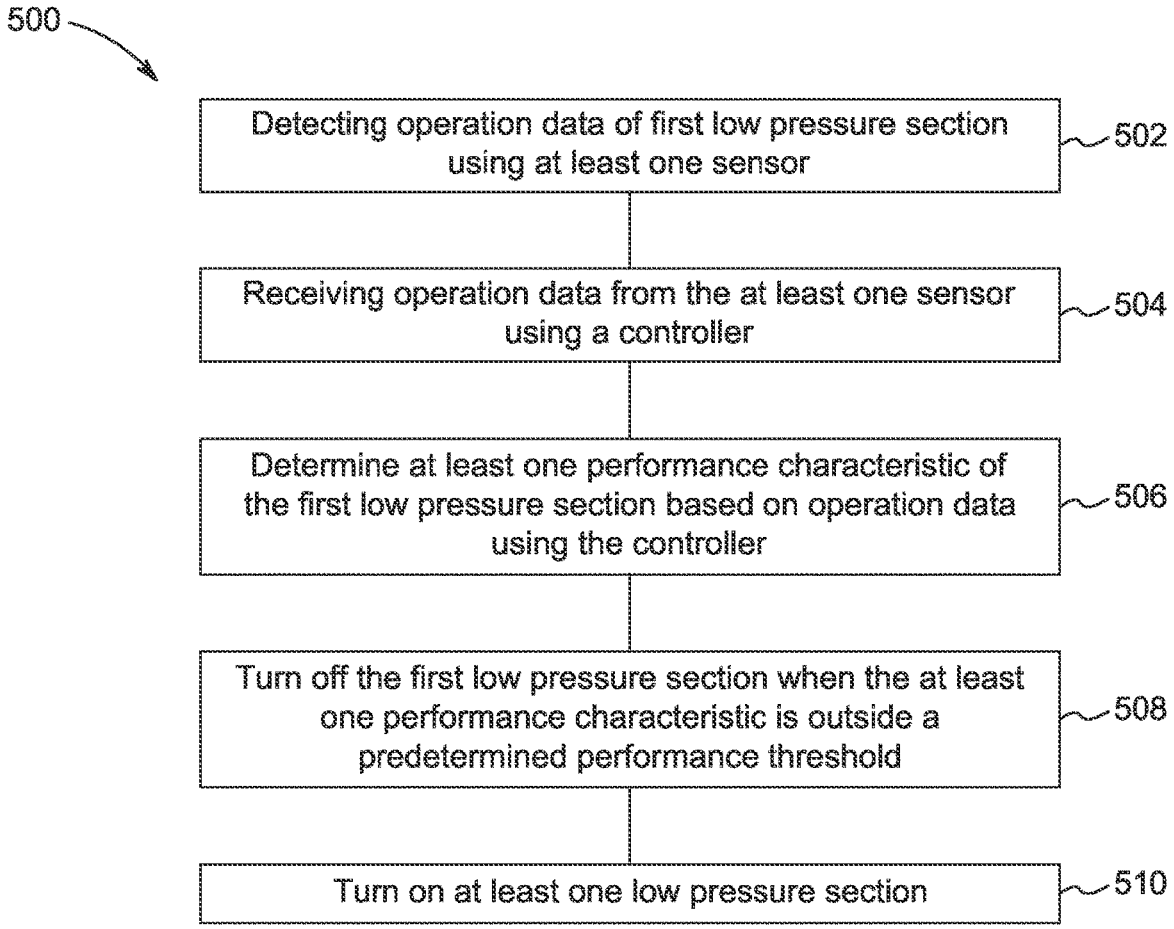
FIG. 4 is a representative schematic of method of operating a steam turbine in accordance with another embodiment or aspect of the present disclosure.

Having described the structure of the steam turbine 200, a method 500 of operating the steam turbine 200 will now be described with reference to FIG. 4. At 502, the method 500 may include detecting, with the at least one sensor 220, operation data of the first low pressure section 216 of the low pressure stage 204 of the steam turbine 200. At 504, the method 500 may include receiving, with the controller 222 having the at least one processor 224, the operation data from the at least one sensor 222 during operation of the first low pressure section 216. At 506, the method 500 may include determining, with the controller 222, at least one performance characteristic of the first low pressure section 216 based on the operation data. At 508, the method 500 may include turning off the first low pressure section 216 when the at least one performance characteristic of the first low pressure section 216 is outside a predetermined performance threshold. At 510, the method 500 may include turning on the at least one second low pressure section 218.

Although embodiments or aspects have been described in detail for the purpose of illustration and description, it is to be understood that such detail is solely for that purpose and that embodiments or aspects are not limited to the disclosed embodiments or aspects, but, on the contrary, are intended to cover modifications and equivalent arrangements that are within the spirit and scope of the appended claims. For example, it is to be understood that the present disclosure contemplates that, to the extent possible, one or more features of any embodiment or aspect can be combined with one or more features of any other embodiment or aspect. In fact, many of these features can be combined in ways not specifically recited in the claims and/or disclosed in the specification. Although each dependent claim listed below may directly depend on only one claim, the disclosure of possible implementations includes each dependent claim in combination with every other claim in the claim set.

The invention claimed is:

1. A steam turbine comprising:

a high pressure stage;

a low pressure stage; and a controller having at least one processor, the controller being operatively connected to at least the low pressure stage, wherein the low pressure stage comprises:

a first low pressure section having a sensor configured for detecting operation data of the first low pressure section; and at least one second low pressure section;

wherein the at least one processor is programmed or configured to:

receive the operation data from the first sensor during operation of the first low pressure section;

determine at least one performance characteristic of the first low pressure section based on the operation data;

turn off the first low pressure section when the at least one performance characteristic of the first low pressure section is outside a predetermined performance threshold; and turn on the at least one second low pressure section.

2. The steam turbine according to claim 1, wherein the steam turbine is configured for continuous operation during turning off of the first low pressure section and turning on of the at least one second low pressure section.

3. The steam turbine according to claim 1, wherein the at least one performance characteristic is operating efficiency of the first low pressure section.

4. The steam turbine according to claim 1, further comprising a high pressure steam feed in fluid communication with the high pressure stage, wherein the high pressure steam feed is connected to a steam source.

5. The steam turbine according to claim 4, wherein the steam source is a geothermal steam source.

6. The steam turbine according to claim 1, further comprising a low pressure steam feed in fluid communication with the first low pressure section and the at least one second low pressure section.

7. The steam turbine according to claim 1, further comprising an intermediate pressure stage between the high pressure stage and the low pressure stage.

8. A method of operating a steam turbine having a high pressure stage and a low pressure stage, the method comprising:

detecting, with a sensor, operation data of a first low pressure section of the low pressure stage;

receiving, with a controller having at least one processor, the operation data from the sensor during operation of the first low pressure section;

determining, with the controller, at least one performance characteristic of the low pressure section based on the operation data;

turning off the first low pressure section when the at least one performance characteristic of the first low pressure section is outside a predetermined performance threshold; and turning on the at least one second low pressure section.

9. The method according to claim 8, wherein the steam turbine is configured for continuous operation during turning off of the first low pressure section and turning on of the at least one second low pressure section.

10. The method according to claim 8, wherein the at least one performance characteristic is operating efficiency of the first low pressure section.

11. The method according to claim 8, further comprising delivering a high pressure steam to the high pressure stage via a high pressure steam feed, wherein the high pressure steam feed is connected to a steam source.

12. The method according to claim 11, wherein the steam source is a geothermal steam source.

13. The method according to claim 8, wherein the steam turbine further comprises an intermediate pressure stage between the high pressure stage and the low pressure stage.

14. A power generation system comprising:

a steam turbine and a generator driven by the steam turbine, wherein the steam turbine comprises:

a high pressure stage;

a low pressure stage; and a controller having at least one processor, the controller being operatively connected to at least the low pressure stage, wherein the low pressure stage comprises:

a first low pressure section having a sensor configured for detecting operation data of the first low pressure section; and at least one second low pressure section;

wherein the at least one processor is programmed or configured to:

receive the operation data from the first sensor during operation of the first low pressure section;

determine at least one performance characteristic of the first low pressure section based on the operation data;

turn off the first low pressure section when the at least one performance characteristic of the first low pressure section is outside a predetermined performance threshold; and turn on the at least one second low pressure section.

15. The power generation system according to claim 14, wherein the steam turbine is configured for continuous operation during turning off of the first low pressure section and turning on of the at least one second low pressure section.

16. The power generation system according to claim 14, wherein the at least one performance characteristic is operating efficiency of the first low pressure section.

17. The power generation system according to claim 14, further comprising a high pressure steam feed in fluid communication with the high pressure stage, wherein the high pressure steam feed is connected to a steam source.

18. The power generation system according to claim 17, wherein the steam source is a geothermal steam source.

19. The power generation system according to claim 14, further comprising a low pressure steam feed in fluid communication with the first low pressure section and the at least one second low pressure section.

20. The power generation system according to claim 14, further comprising an intermediate pressure stage between the high pressure stage and the low pressure stage.

* * * * *